US007938345B2

(12) United States Patent
Teeter, Jr. et al.

(10) Patent No.: US 7,938,345 B2
(45) Date of Patent: May 10, 2011

(54) DRY MILLING CORN FRACTIONATION PROCESS

(75) Inventors: Floyd C. Teeter, Jr., Woodbury, MN (US); Gregg L. Haider, Dassel, MN (US); Jeffrey D. Scott, Jr., Blaine, MN (US); Bruce D. MacKinnon, Blaine, MN (US); Jesse L. Devine, St. Paul, MN (US)

(73) Assignee: Crown Iron Works Company, Roseville, MN (US)

( * ) Notice: Subject to any disclaimer, the term of this patent is extended or adjusted under 35 U.S.C. 154(b) by 143 days.

(21) Appl. No.: 12/542,394

(22) Filed: Aug. 17, 2009

(65) Prior Publication Data

US 2010/0059609 A1 Mar. 11, 2010

Related U.S. Application Data

(60) Provisional application No. 61/089,215, filed on Aug. 15, 2008.

(51) Int. Cl.
*B02C 9/00* (2006.01)

(52) U.S. Cl. ..... 241/12; 241/13

(58) Field of Classification Search ..... 241/6–13
See application file for complete search history.

(56) References Cited

U.S. PATENT DOCUMENTS

| | | | |
|---|---|---|---|
| 3,399,839 | A | 9/1968 | Anderson |
| 4,089,259 | A | 5/1978 | Stickle |
| 4,131,061 | A | 12/1978 | Skeen |
| 4,181,748 | A | 1/1980 | Chwalek |
| 4,189,503 | A | 2/1980 | Giguere |
| 4,207,118 | A | 6/1980 | Bonnyay |
| 4,301,183 | A | 11/1981 | Giguere |
| 4,361,651 | A | 11/1982 | Keim |
| 4,365,546 | A | 12/1982 | Giguere |
| 4,495,207 | A | 1/1985 | Christianson |
| 4,555,409 | A | 11/1985 | Hart |
| 4,774,009 | A | 9/1988 | Hensley |
| 4,865,863 | A | 9/1989 | Prosise |
| 5,166,336 | A | 11/1992 | Yamauchi |
| 5,198,035 | A | 3/1993 | Lee |
| 5,250,313 | A | 10/1993 | Giguere |
| 5,260,089 | A | 11/1993 | Thornberg |
| 5,932,018 | A | 8/1999 | Palardy |
| 5,968,585 | A | 10/1999 | Liaw |
| 6,254,914 | B1 | 7/2001 | Singh |
| 6,398,036 | B1 | 6/2002 | Griebat |
| 6,409,105 | B1 | 6/2002 | Griebat |

(Continued)

FOREIGN PATENT DOCUMENTS

EP 1213054 B1 5/2006

(Continued)

OTHER PUBLICATIONS

"The Path to Sustainable Ethanol", http://www.ceralprocess.com/, Cereal Process Technologies, printed May 20, 2008, 5 pages.

(Continued)

*Primary Examiner* — Faye Francis
(74) *Attorney, Agent, or Firm* — Fredrickson & Byron, PA

(57) ABSTRACT

A method for fractionating whole kernel corn into bran, germ and endosperm fractions. Corn (tempered or non-tempered) is processed through an impact mill and through a screener to divide the initial feed stream into two or more flows or sub-streams. The substreams or portions thereof may be further processed through a plurality of aspirators, roller mills and screeners to provide bran, germ and endosperm fractions of desired purity levels.

9 Claims, 28 Drawing Sheets

U.S. PATENT DOCUMENTS

| | | | |
|---|---|---|---|
| 6,550,700 | B1 | 4/2003 | Griebat |
| 6,610,831 | B1 | 8/2003 | McInnis |
| 6,648,978 | B2 | 11/2003 | Liaw |
| 6,936,110 | B2 | 8/2005 | Van Thorre |
| 6,953,165 | B1 | 10/2005 | Griebat |
| 6,962,722 | B2 | 11/2005 | Dawley |
| 7,074,603 | B2 | 7/2006 | Verser |
| 7,083,954 | B2 | 8/2006 | Jakel |
| 7,104,479 | B1 | 9/2006 | Griebat |
| 7,138,257 | B2 | 11/2006 | Galli |
| 7,507,562 | B2 | 3/2009 | Verser |
| 2004/0187863 | A1 | 9/2004 | Langhauser |
| 2005/0255190 | A1 | 11/2005 | Mehra |
| 2006/0029702 | A1 | 2/2006 | McPherson |
| 2007/0184541 | A1 | 8/2007 | Karl |
| 2008/0089996 | A1 | 4/2008 | Yokoyama |

FOREIGN PATENT DOCUMENTS

| | | | |
|---|---|---|---|
| EP | 1626092 | B1 | 9/2007 |

OTHER PUBLICATIONS

"The Impact Milling & Grinding Process", http://www.entoleter.com/process.htm, Entoleter LLC, printed Jul. 22, 2008, 1 page.

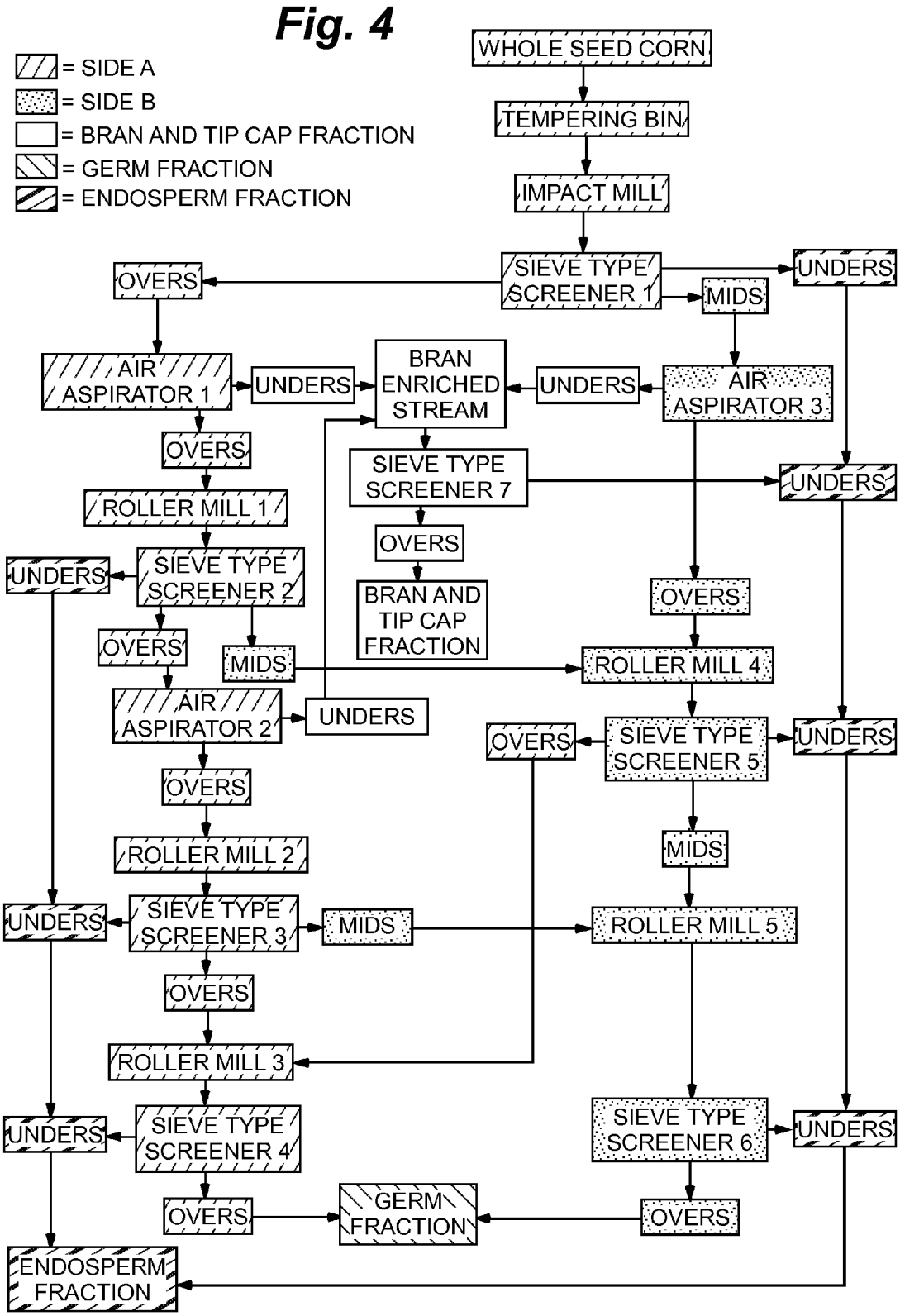
Fig. 4
= SIDE A
= SIDE B
= BRAN AND TIP CAP FRACTION
= GERM FRACTION
= ENDOSPERM FRACTION
WHOLE SEED CORN
TEMPERING BIN
IMPACT MILL
SIEVE TYPE SCREENER 1
OVERS
UNDERS
MIDS
AIR ASPIRATOR 1
UNDERS
BRAN ENRICHED STREAM
UNDERS
AIR ASPIRATOR 3
OVERS
SIEVE TYPE SCREENER 7
UNDERS
ROLLER MILL 1
OVERS
BRAN AND TIP CAP FRACTION
UNDERS
SIEVE TYPE SCREENER 2
OVERS
OVERS
OVERS
MIDS
ROLLER MILL 4
AIR ASPIRATOR 2
UNDERS
OVERS
SIEVE TYPE SCREENER 5
UNDERS
OVERS
MIDS
ROLLER MILL 2
UNDERS
SIEVE TYPE SCREENER 3
MIDS
ROLLER MILL 5
OVERS
ROLLER MILL 3
UNDERS
SIEVE TYPE SCREENER 4
SIEVE TYPE SCREENER 6
UNDERS
OVERS
GERM FRACTION
OVERS
ENDOSPERM FRACTION

Fig. 5

SEED PREP AND MILLING RUN 1

| SEED CORN | UNITS | # | lbs OIL | lbs WATER | lbs SOLIDS |
|---|---|---|---|---|---|
| WT IN: | NET | 450 | 14.68 | 64.44 | 371.88 |
| MOISTURE: | % | 14.32 | | | |
| OIL: | % | 3.04 | | | |
| DENSITY: | lb/cft | 45.44 | | | |

| TEMP. BIN | UNITS | # | lbs OIL | lbs WATER | lbs SOLIDS | |
|---|---|---|---|---|---|---|
| WT IN: | NET | 473.81 | 13.68 | 92.91 | 371.88 | |
| MOISTURE: | % | 19.61 | | | | |
| OIL: | % | 2.89 | | H20 ADDED | 23.81 | 5% |
| DENSITY: | lb/cft | 43.40 | | | | |

| PIN MILL | UNITS | # | lbs OIL | lbs WATER | lbs SOLIDS |
|---|---|---|---|---|---|
| WT IN: | NET | 473.805 | 13.68 | 95.070331 | 371.88 |
| MOISTURE: | % | 19.01 | | | |
| OIL: | % | 2.89 | | | |
| DENSITY: | lb/cft | 43.40 | | | |
| **TO SCREENER 1** | | | | | |

Fig. 6

SEED PREP AND MILLING RUN 1

SCREENER 1 (6 AND 8 MESH)

| > #6 MESH | UNITS | # | lbs OIL | lbs WATER | lbs SOLIDS |
|---|---|---|---|---|---|
| WT IN: | % | 40.33 | 12.11 | 36.03 | 142.65 |
| NET WT | lbs. | 191.09 | | | |
| MOISTURE: | % | 19.01 | | | |
| OIL: | % | 6.34 | 18% | | |
| DENSITY: | lb/cft | 26.59 | | | |
| **1ST OVERS TO SIDE A ASPIRATOR 1** | | | | | |

| <6>8 MESH | UNITS | # | lbs OIL | lbs WATER | lbs SOLIDS |
|---|---|---|---|---|---|
| WT IN: | % | 18.57 | 2.47 | 15.05 | 70.01 |
| NET WT | lbs. | 87.99 | | | |
| MOISTURE: | % | 17.62 | | | |
| OIL: | % | 2.81 | | | |
| DENSITY: | lb/cft | 36.24 | | | |
| **1ST MIDS TO SIDE B ASPIRATOR 3** | | | | | |

| <8 MESH | UNITS | # | lbs OIL | lbs WATER | lbs SOLIDS |
|---|---|---|---|---|---|
| WT IN: | % | 41.10 | 4.83 | 36.32 | 153.59 |
| NET WT | lbs. | 194.73 | | | |
| MOISTURE: | % | 18.65 | | | |
| OIL: | % | 2.48 | | | |
| DENSITY: | lb/cft | 38.42 | | | |
| **1ST UNDERS TO ENDOSPERM STREAM** | | | | | |

| MATERIAL OUT | % |
|---|---|
| SOLIDS | 41.30 |
| OIL | 35.30 |
| MOISTURE | 39.09 |

Fig. 7

SEED PREP AND MILLING RUN 1

SIDE A

ASPIRATOR 1

| > #6 MESH | UNITS | # | lbs OIL | lbs WATER | lbs SOLIDS |
|---|---|---|---|---|---|
| WT IN: | % | 100.00 | 12.11 | 36.33 | 142.65 |
| NET WT | lbs. | 191.09 | | | |
| ASP #1 OVERS | UNITS | # | lbs OIL | lbs WATER | lbs SOLIDS |
| WT IN: | % | 84.44 | 7.79 | 27.37 | 126.19 |
| NET WT | lbs. | 161.35 | | | |
| MOISTURE: | % | 16.96 | | | |
| OIL: | % | 4.83 | | | |
| DENSITY: | lb/cft | 35.47 | | | |
| **2ND OVERS TO SIDE A ROLLER MILL 1** | | | | | |

| ASP #1 UNDERS | UNITS | # | lbs OIL | lbs WATER | lbs SOLIDS |
|---|---|---|---|---|---|
| WT IN: | % | 15.56 | 1.00 | 5.82 | 22.92 |
| NET WT | lbs. | 29.73 | | | |
| MOISTURE: | % | 19.56 | | | |
| OIL: | % | 3.37 | | | |
| DENSITY: | lb/cft | 8.28 | | | |
| **1ST BRAN UNDERS TO BRAN STREAM SCREENER 7** | | | | | |

| MATERIAL OUT | % |
|---|---|
| SOLIDS | 6.16 |
| OIL | 7.32 |
| MOISTURE | 9.03 |

Fig. 8

SEED PREP AND MILLING RUN 1

ROLLER MILL 1

| .040 GAP | UNITS | # | lbs OIL | lbs WATER | lbs SOLIDS |
|---|---|---|---|---|---|
| WT IN: | % | 100.00 | 7.79 | 27.37 | 126.19 |
| NET WT | lbs. | 161.35 | | | |

SCREENER 2 (6 AND 8 MESH)

| >#6 MESH | UNITS | # | lbs OIL | lbs WATER | lbs SOLIDS |
|---|---|---|---|---|---|
| WT IN: | % | 40.92 | 6.87 | 10.50 | 48.65 |
| NET WT | lbs. | 66.03 | | | |
| MOISTURE: | % | 15.91 | | | |
| OIL: | % | 10.40 | | | |
| DENSITY: | lb/cft | 25.75 | | | |
| **3RD OVERS TO SIDE A ASPIRATOR 2** | | | | | |

| <6>8 MESH | UNITS | # | lbs OIL | lbs WATER | lbs SOLIDS |
|---|---|---|---|---|---|
| WT IN: | % | 21.28 | 0.79 | 5.79 | 27.76 |
| NET WT | lbs. | 34.34 | | | |
| MOISTURE: | % | 16.85 | | | |
| OIL: | % | 2.29 | | | |
| DENSITY: | lb/cft | 37.72 | | | |
| **2ND MIDS TO SIDE B ROLLER MILL 4** | | | | | |

| <8 MESH | UNITS | # | lbs OIL | lbs WATER | lbs SOLIDS |
|---|---|---|---|---|---|
| WT IN: | % | 41.10 | 0.66 | 11.13 | 54.52 |
| NET WT | lbs. | 66.32 | | | |
| MOISTURE: | % | 16.79 | | | |
| OIL: | % | 1.00 | | | |
| DENSITY: | lb/cft | 43.70 | | | |
| **2ND UNDERS TO ENDOSPERM STREAM** | | | | | |

| MATERIAL OUT | % |
|---|---|
| SOLIDS | 14.66 |
| OIL | 4.85 |
| MOISTURE | 17.28 |

Fig. 9

SEED PREP AND MILLING RUN 1

ASPIRATOR 2

| > #6 MESH | UNITS | # | lbs OIL | lbs WATER | lbs SOLIDS |
|---|---|---|---|---|---|
| WT IN: | % | 100.00 | 6.87 | 10.50 | 48.65 |
| NET WT | lbs. | 66.03 | | | |
| ASP #2 OVERS | UNITS | # | lbs OIL | lbs WATER | lbs SOLIDS |
| WT IN: | % | 98.21 | 6.15 | 10.23 | 48.47 |
| NET WT | lbs. | 64.84 | | | |
| MOISTURE: | % | 15.77 | | | |
| OIL: | % | 9.48 | | | |
| DENSITY: | lb/cft | 33.09 | | | |
| **4TH OVERS TO SIDE A ROLLER MILL 2** | | | | | |

| ASP #2 UNDERS | UNITS | # | lbs OIL | lbs WATER | lbs SOLIDS |
|---|---|---|---|---|---|
| WT IN: | % | 1.79 | 0.02 | 0.17 | 1.00 |
| NET WT | lbs. | 1.18 | | | |
| MOISTURE: | % | 14.2 | | | |
| OIL: | % | 1.47 | | | |
| DENSITY: | lb/cft | 12.61 | | | |
| **2ND BRAN UNDERS TO BRAN STREAM SCREENER 7** | | | | | |

| MATERIAL OUT | % |
|---|---|
| SOLIDS | 0.27 |
| OIL | 0.13 |
| MOISTURE | 0.26 |

Fig. 10

SEED PREP AND MILLING RUN 1

ROLLER MILL 2

| .020 GAP | UNITS | # | lbs OIL | lbs WATER | lbs SOLIDS |
|---|---|---|---|---|---|
| WT IN: | % | 100.00 | 6.87 | 10.50 | 48.65 |
| NET WT | lbs. | 64.84 | | | |

SCREENER 3 (6 AND 8 MESH)

| > #8 MESH | UNITS | # | lbs OIL | lbs WATER | lbs SOLIDS |
|---|---|---|---|---|---|
| WT IN: | % | 57.71 | 5.10 | 5.88 | 26.44 |
| NET WT | lbs. | 37.42 | | | |
| MOISTURE: | % | 15.72 | | | |
| OIL: | % | 13.62 | 16.16% | DB | |
| DENSITY: | lb/cft | 25.75 | | | |
| **5TH OVERS TO SIDE A ROLLER MILL 3** | | | | | |

| | UNITS | # | lbs OIL | lbs WATER | lbs SOLIDS |
|---|---|---|---|---|---|
| WT IN: | % | 21.87 | 0.73 | 2.32 | 11.13 |
| NET WT | lbs. | 14.18 | | | |
| MOISTURE: | % | 16.37 | | | |
| OIL: | % | 5.16 | 6.17% | DB | |
| DENSITY: | lb/cft | 0.00 | | | |
| **3RD MIDS TO SIDE B ROLLER MILL 5** | | | | | |

| <8 MESH | UNITS | # | lbs OIL | lbs WATER | lbs SOLIDS |
|---|---|---|---|---|---|
| WT IN: | % | 41.10 | 0.29 | 4.44 | 21.92 |
| NET WT | lbs. | 26.65 | | | |
| MOISTURE: | % | 16.66 | | | |
| OIL: | % | 1.10 | | | |
| DENSITY: | lb/cft | 43.70 | | | |
| **3RD UNDERS TO ENDOSPERM STREAM** | | | | | |

Fig. 11

SEED PREP AND MILLING RUN 1

ROLLER MILL 3 (5TH OVERS + 8TH OVERS)

| .020 GAP | UNITS | # | lbs OIL | lbs WATER | lbs SOLIDS |
|---|---|---|---|---|---|
| WT IN: | % | 100.00 | 5.10 | 5.88 | 26.44 |
| NET WT | lbs. | 50.64 | | | |

SCREENER 4 (10 MESH)

| > #10 MESH | UNITS | # | lbs OIL | lbs WATER | lbs SOLIDS |
|---|---|---|---|---|---|
| WT IN: | % | 74.14 | 6.96 | 5.96 | 26.44 |
| NET WT | lbs. | 40.08 | | | |
| MOISTURE: | % | 14.87 | | | |
| OIL: | % | 17.37 | 20.40% | DB | |
| DENSITY: | lb/cft | 25.75 | | | |
| **6TH OVERS TO GERM STREAM** | | | | | |

| <10 MESH | UNITS | # | lbs OIL | lbs WATER | lbs SOLIDS |
|---|---|---|---|---|---|
| WT IN: | % | 20.86 | 0.30 | 1.59 | 8.68 |
| NET WT | lbs. | 10.56 | | | |
| MOISTURE: | % | 15.02 | | | |
| OIL: | % | 2.86 | | | |
| DENSITY: | lb/cft | 43.70 | | | |
| **4TH UNDERS TO ENDOSPERM STREAM** | | | | | |

Fig. 12

SEED PREP AND MILLING RUN 1

SIDE B

1ST MIDS FROM SCREENER 1

| <6>8 MESH | UNITS | # | lbs OIL | lbs WATER | lbs SOLIDS |
|---|---|---|---|---|---|
| WT IN: | % | 18.57 | 2.47 | 15.50 | 70.01 |
| NET WT | lbs. | 87.99 | | | |
| MOISTURE: | % | 17.62 | | | |
| OIL: | % | 2.81 | | | |
| DENSITY: | lb/cft | 36.24 | | | |

ASPIRATOR 3

| <6>8 MESH | UNITS | # | lbs OIL | lbs WATER | lbs SOLIDS |
|---|---|---|---|---|---|
| WT IN: | % | 100.00 | 2.47 | 15.50 | 70.01 |
| NET WT | lbs. | 87.99 | | | |
| ASP #3 OVERS | UNITS | # | lbs OIL | lbs WATER | lbs SOLIDS |
| WT IN: | % | 96.98 | 2.78 | 14.25 | 68.30 |
| NET WT | lbs. | 85.33 | | | |
| MOISTURE: | % | 16.7 | | | |
| OIL: | % | 3.26 | | | |
| DENSITY: | lb/cft | 42.61 | | | |
| **7TH OVERS TO SIDE B ROLLER MILL 4** | | | | | |

| ASP #3 UNDERS | UNITS | # | lbs OIL | lbs WATER | lbs SOLIDS |
|---|---|---|---|---|---|
| WT IN: | % | 3.02 | 0.28 | 0.35 | 2.03 |
| NET WT | lbs. | 2.66 | | | |
| MOISTURE: | % | 13.05 | | | |
| OIL: | % | 10.65 | | | |
| DENSITY: | lb/cft | 11.73 | | | |
| **3RD BRAN UNDERS TO BRAN STREAM SCREENER 7** | | | | | |

| MATERIAL OUT | % |
|---|---|
| SOLIDS | 0.55 |
| OIL | 2.07 |
| MOISTURE | 0.54 |

Fig. 13

SEED PREP AND MILLING RUN 1

ROLLER MILL 4 (2ND MIDS + 7TH OVERS)

| .040 GAP | UNITS | # | lbs OIL | lbs WATER | lbs SOLIDS |
|---|---|---|---|---|---|
| WT IN: | % | 100.00 | 3.57 | 20.04 | 96.06 |
| NET WT | lbs. | 119.66 | | | |

SCREENER 5 (6 AND 8 MESH)

| > #6 MESH | UNITS | # | lbs OIL | lbs WATER | lbs SOLIDS |
|---|---|---|---|---|---|
| WT IN: | % | 11.05 | 1.16 | 2.02 | 10.04 |
| NET WT | lbs. | 13.22 | | | |
| MOISTURE: | % | 15.28 | | | |
| OIL: | % | 8.81 | | | |
| DENSITY: | lb/cft | 30.72 | | | |
| **8TH OVER TO SIDE A ROLLER MILL 3** | | | | | |

| <6>8 MESH | UNITS | # | lbs OIL | lbs WATER | lbs SOLIDS |
|---|---|---|---|---|---|
| WT IN: | % | 48.47 | 1.28 | 9.05 | 47.68 |
| NET WT | lbs. | 58.00 | | | |
| MOISTURE: | % | 15.6 | | | |
| OIL: | % | 2.20 | | | |
| DENSITY: | lb/cft | 40.78 | | | |
| **4TH MIDS TO SIDE B ROLLER MILL 5** | | | | | |

| <8 MESH | UNITS | # | lbs OIL | lbs WATER | lbs SOLIDS |
|---|---|---|---|---|---|
| WT IN: | % | 40.48 | 0.29 | 7.39 | 40.76 |
| NET WT | lbs. | 48.44 | | | |
| MOISTURE: | % | 15.26 | | | |
| OIL: | % | 0.59 | | | |
| DENSITY: | lb/cft | 44.59 | | | |
| **5TH UNDERS TO ENDOSPERM STREAM** | | | | | |

| MATERIAL OUT | % |
|---|---|
| SOLIDS | 10.96 |
| OIL | 2.09 |
| MOISTURE | 11.47 |

Fig. 14

SEED PREP AND MILLING RUN 1

ROLLER MILL 5 (3RD MIDS + 4TH MIDS)

| .010 GAP | UNITS | # | lbs OIL | lbs WATER | lbs SOLIDS |
|---|---|---|---|---|---|
| WT IN: | % | 100.00 | 0.71 | 10.67 | 60.80 |
| NET WT | lbs. | 72.18 | | | |
| MOISTURE: | % | 14.78 | | | |
| OIL: | % | 0.99 | | | |
| DENSITY: | lb/cft | 0.00 | | | |

| MATERIAL OUT | % |
|---|---|
| SOLIDS | 16.35 |
| OIL | 5.22 |
| MOISTURE | 16.56 |

SCREENER 6 (STREAM FROM ROLLER MILLS)

| > #6 MESH | UNITS | # | lbs OIL | lbs WATER | lbs SOLIDS |
|---|---|---|---|---|---|
| WT IN: | % | 48.94 | 0.30 | 5.45 | 29.58 |
| NET WT | lbs. | 35.33 | | | |
| MOISTURE: | % | 15.42 | | | |
| OIL: | % | 0.86 | | | |
| DENSITY: | lb/cft | 30.72 | | | |
| **9TH OVERS TO GERM STREAM** | | | | | |

| <6 MESH | UNITS | # | lbs OIL | lbs WATER | lbs SOLIDS |
|---|---|---|---|---|---|
| WT IN: | % | 51.06 | 1.75 | 5.55 | 29.56 |
| NET WT | lbs. | 36.86 | | | |
| MOISTURE: | % | 15.07 | | | |
| OIL: | % | 4.74 | | | |
| DENSITY: | lb/cft | 44.59 | | | |
| **6TH UNDERS TO ENDOSPERM STREAM** | | | | | |

| MATERIAL OUT | % |
|---|---|
| SOLIDS | 7.95 |
| OIL | 12.77 |
| MOISTURE | 8.62 |

Fig. 15

SEED PREP AND MILLING RUN 1

BRAN ENRICHED STREAM
(1ST, 2ND AND 3RD BRAN UNDERS)

| NET IN | lbs OIL | lbs WATER | lbs SOLIDS |
|---|---|---|---|
| 33.57 | 1.30 | 6.33 | 25.94 |

SCREENER 7 (6 AND 8 MESH)

| > #6 MESH | UNITS | # | lbs OIL | lbs WATER | lbs SOLIDS |
|---|---|---|---|---|---|
| WT IN: | % | 68.91 | 0.33 | 3.82 | 18.98 |
| NET WT | lbs. | 23.13 | | | |
| MOISTURE: | % | 16.53 | | | |
| OIL: | % | 1.41 | | | |
| DENSITY: | lb/cft | 30.72 | | | |
| **10TH OVERS TO BRAN AND TIP CAP STREAM** | | | | | |

| <8 MESH | UNITS | # | lbs OIL | lbs WATER | lbs SOLIDS |
|---|---|---|---|---|---|
| WT IN: | % | 31.09 | 0.35 | 1.67 | 8.42 |
| NET WT | lbs. | 10.44 | | | |
| MOISTURE: | % | 16 | | | |
| OIL: | % | 3.37 | | | |
| DENSITY: | lb/cft | 44.59 | | | |
| **7TH UNDERS TO ENDOSPERM STREAM** | | | | | |

Fig. 16

SEED PREP AND MILLING RUN 1

FINAL GERM STREAM

| | UNITS | # | lbs OIL | lbs WATER | lbs SOLIDS |
|---|---|---|---|---|---|
| WT IN: | % | 100.00 | 7.27 | 11.41 | 56.73 |
| NET WT | lbs. | 75.41 | | | |
| MOISTURE: | % | 15.13 | | | |
| OIL: | % | 9.64 | 12.8% | DW | |
| DENSITY: | lb/cft | 30.72 | | | |

| MATERIAL OUT | % |
|---|---|
| SOLIDS | 15.26 |
| OIL | 53.11 |
| MOISTURE | 17.70 |

FINAL BRAN AND TIP CAP STREAM

| | UNITS | # | lbs OIL | lbs WATER | lbs SOLIDS |
|---|---|---|---|---|---|
| WT IN: | % | 100.00 | 0.33 | 3.82 | 18.98 |
| NET WT | lbs. | 23.13 | | | |
| MOISTURE: | % | 16.53 | | | |
| OIL: | % | 1.41 | 1.7% | DW | |
| DENSITY: | lb/cft | 30.72 | | | |

| MATERIAL OUT | % |
|---|---|
| SOLIDS | 5.10 |
| OIL | 2.38 |
| MOISTURE | 5.93 |

FINAL ENDOSPERM STREAM

| | UNITS | # | lbs OIL | lbs WATER | lbs SOLIDS |
|---|---|---|---|---|---|
| WT IN: | % | 100.00 | 8.47 | 68.10 | 317.43 |
| NET WT | lbs. | 394.00 | | | |
| MOISTURE: | % | 17.26 | | | |
| OIL: | % | 2.15 | 2.7% | DW | |
| DENSITY: | lb/cft | 30.72 | | | |

| MATERIAL OUT | % |
|---|---|
| SOLIDS | 85.36 |
| OIL | 61.93 |
| MOISTURE | 105.67 |

Fig. 17

SEED PREP AND MILLING RUN 2

| SEED CORN | UNITS | # | lbs OIL | lbs WATER | lbs SOLIDS |
|---|---|---|---|---|---|
| WT IN: | NET | 200 | 5.78 | 28.12 | 166.1 |
| MOISTURE: | % | 14.06 | | | |
| OIL: | % | 2.89 | | | |
| DENSITY: | lb/cft | 45.44 | | | |

| TEMP. BIN | UNITS | # | lbs OIL | lbs WATER | lbs SOLIDS |
|---|---|---|---|---|---|
| WT IN: | NET | 206 | 5.78 | 33.681 | 166.1 |
| MOISTURE: | % | 16.35 | | | |
| OIL: | % | 2.81 | | H20 ADDED | 6 |
| DENSITY: | lb/cft | 43.40 | | | |

| PIN MILL | UNITS | # | lbs OIL | lbs WATER | lbs SOLIDS |
|---|---|---|---|---|---|
| WT IN: | NET | 206 | 5.78 | 33.578 | 166.1 |
| MOISTURE: | % | 16.3 | | | |
| OIL: | % | 2.81 | | | |
| DENSITY: | lb/cft | 43.40 | | | |
| **TO SCREENER 1** | | | | | |

Fig. 18

SEED PREP AND MILLING RUN 2

SCREENER 1 (6 AND 8 MESH)

| > #6 MESH | UNITS | # | lbs OIL | lbs WATER | lbs SOLIDS |
|---|---|---|---|---|---|
| WT IN: | % | 42.01 | 4.31 | 13.85 | 68.38 |
| NET WT | lbs. | 86.54 | | | |
| MOISTURE: | % | 16 | | | |
| OIL: | % | 4.98 | | | |
| DENSITY: | lb/cft | 26.59 | | | |
| **1ST OVERS TO SIDE A ASPIRATOR 1** | | | | | |

| <6>8 MESH | UNITS | # | lbs OIL | lbs WATER | lbs SOLIDS |
|---|---|---|---|---|---|
| WT IN: | % | 16.85 | 0.90 | 5.55 | 28.25 |
| NET WT | lbs. | 34.71 | | | |
| MOISTURE: | % | 16 | | | |
| OIL: | % | 2.60 | | | |
| DENSITY: | lb/cft | 36.24 | | | |
| **1ST MIDS TO SIDE B ASPIRATOR 3** | | | | | |

| <8 MESH | UNITS | # | lbs OIL | lbs WATER | lbs SOLIDS |
|---|---|---|---|---|---|
| WT IN: | % | 41.14 | 0.97 | 13.56 | 70.21 |
| NET WT | lbs. | 84.75 | | | |
| MOISTURE: | % | 16 | | | |
| OIL: | % | 1.15 | | | |
| DENSITY: | lb/cft | 38.42 | | | |
| **1ST UNDERS TO ENDOSPERM STREAM** | | | | | |

| MATERIAL OUT | % |
|---|---|
| SOLIDS | 42.27 |
| OIL | 16.86 |
| MOISTURE | 40.26 |

Fig. 19

SEED PREP AND MILLING RUN 2

SIDE A

ASPIRATOR 1

| > #6 MESH | UNITS | # | lbs OIL | lbs WATER | lbs SOLIDS |
|---|---|---|---|---|---|
| WT IN: | % | 100.00 | 4.31 | 13.85 | 68.38 |
| NET WT | lbs. | 86.54 | | | |
| ASP #1 OVERS | UNITS | # | lbs OIL | lbs WATER | lbs SOLIDS |
| WT IN: | % | 90.10 | 3.96 | 12.48 | 61.54 |
| NET WT | lbs. | 77.97 | | | |
| MOISTURE: | % | 16 | | | |
| OIL: | % | 5.08 | | | |
| DENSITY: | lb/cft | 35.47 | | | |
| **2ND OVERS TO SIDE A ROLLER MILL 1** | | | | | |

| ASP #1 UNDERS | UNITS | # | lbs OIL | lbs WATER | lbs SOLIDS |
|---|---|---|---|---|---|
| WT IN: | % | 9.90 | 0.12 | 1.29 | 7.16 |
| NET WT | lbs. | 8.57 | | | |
| MOISTURE: | % | 15 | | | |
| OIL: | % | 1.38 | | | |
| DENSITY: | lb/cft | 8.28 | | | |
| **1ST BRAN UNDERS TO BRAN STREAM SCREENER 7** | | | | | |

| MATERIAL OUT | % |
|---|---|
| SOLIDS | 4.31 |
| OIL | 2.05 |
| MOISTURE | 4.57 |

Fig. 20

SEED PREP AND MILLING RUN 2

ROLLER MILL 1

| .040 GAP | UNITS | # | lbs OIL | lbs WATER | lbs SOLIDS |
|---|---|---|---|---|---|
| WT IN: | % | 100.00 | 3.96 | 12.48 | 61.54 |
| NET WT | lbs. | 77.97 | | | |

SCREENER 2 (6 AND 8 MESH)

| >#6 MESH | UNITS | # | lbs OIL | lbs WATER | lbs SOLIDS |
|---|---|---|---|---|---|
| WT IN: | % | 48.35 | 4.67 | 6.25 | 26.78 |
| NET WT | lbs. | 37.70 | | | |
| MOISTURE: | % | 16.58 | | | |
| OIL: | % | 12.39 | 14.85% | DB | |
| DENSITY: | lb/cft | 25.75 | | | |
| **3RD OVERS TO SIDE A ASPIRATOR 2** | | | | | |

| <6>8 MESH | UNITS | # | lbs OIL | lbs WATER | lbs SOLIDS |
|---|---|---|---|---|---|
| WT IN: | % | 20.20 | 0.28 | 2.59 | 12.88 |
| NET WT | lbs. | 15.75 | | | |
| MOISTURE: | % | 16.44 | | | |
| OIL: | % | 1.78 | | | |
| DENSITY: | lb/cft | 37.72 | | | |
| **2ND MIDS TO SIDE B ROLLER MILL 4** | | | | | |

| <8 MESH | UNITS | # | lbs OIL | lbs WATER | lbs SOLIDS |
|---|---|---|---|---|---|
| WT IN: | % | 31.58 | 0.11 | 4.07 | 20.44 |
| NET WT | lbs. | 24.62 | | | |
| MOISTURE: | % | 16.54 | | | |
| OIL: | % | 0.46 | | | |
| DENSITY: | lb/cft | 43.70 | | | |
| **2ND UNDERS TO ENDOSPERM STREAM** | | | | | |

| MATERIAL OUT | % |
|---|---|
| SOLIDS | 12.30 |
| OIL | 1.96 |
| MOISTURE | 14.48 |

Fig. 21

SEED PREP AND MILLING RUN 2

ASPIRATOR 2

| > #6 MESH | UNITS | # | lbs OIL | lbs WATER | lbs SOLIDS |
|---|---|---|---|---|---|
| WT IN: | % | 100.00 | 4.67 | 6.25 | 26.78 |
| NET WT | lbs. | 37.07 | | | |
| ASP #2 OVERS | UNITS | # | lbs OIL | lbs WATER | lbs SOLIDS |
| WT IN: | % | 99.33 | 3.36 | 5.78 | 28.30 |
| NET WT | lbs. | 37.45 | | | |
| MOISTURE: | % | 15.44 | | | |
| OIL: | % | 8.98 | | | |
| DENSITY: | lb/cft | 33.09 | | | |
| **4TH OVERS TO SIDE A ROLLER MILL 2** | | | | | |

| ASP #2 UNDERS | UNITS | # | lbs OIL | lbs WATER | lbs SOLIDS |
|---|---|---|---|---|---|
| WT IN: | % | 0.67 | 0.01 | 0.04 | 0.21 |
| NET WT | lbs. | 0.25 | | | |
| MOISTURE: | % | 14.03 | | | |
| OIL: | % | 2.73 | | | |
| DENSITY: | lb/cft | 12.61 | | | |
| **2ND BRAN UNDERS TO BRAN STREAM SCREENER 7** | | | | | |

| MATERIAL OUT | % |
|---|---|
| SOLIDS | 0.13 |
| OIL | 0.12 |
| MOISTURE | 0.13 |

Fig. 22

SEED PREP AND MILLING RUN 2

ROLLER MILL 2

| .020 GAP | UNITS | # | lbs OIL | lbs WATER | lbs SOLIDS |
|---|---|---|---|---|---|
| WT IN: | % | 100.00 | 3.36 | 5.78 | 28.30 |
| NET WT | lbs. | 37.45 | | | |

SCREENER 3 (6 AND 8 MESH)

| > #8 MESH | UNITS | # | lbs OIL | lbs WATER | lbs SOLIDS |
|---|---|---|---|---|---|
| WT IN: | % | 71.13 | 3.99 | 4.45 | 18.20 |
| NET WT | lbs. | 26.64 | | | |
| MOISTURE: | % | 16.71 | | | |
| OIL: | % | 14.98 | 17.99% | DB | |
| DENSITY: | lb/cft | 25.75 | | | |
| **5TH OVERS TO SIDE A ROLLER MILL 3** | | | | | |

| | UNITS | # | lbs OIL | lbs WATER | lbs SOLIDS |
|---|---|---|---|---|---|
| WT IN: | % | 0.00 | 0.00 | 0.00 | 0.00 |
| NET WT | lbs. | 0.00 | | | |
| MOISTURE: | % | 0.00 | | | |
| OIL: | % | 0.00 | 0.00% | DB | |
| DENSITY: | lb/cft | 0.00 | | | |
| **3RD MIDS TO SIDE B ROLLER MILL 5** | | | | | |

| <8 MESH | UNITS | # | lbs OIL | lbs WATER | lbs SOLIDS |
|---|---|---|---|---|---|
| WT IN: | % | 28.59 | 0.22 | 1.77 | 8.72 |
| NET WT | lbs. | 10.71 | | | |
| MOISTURE: | % | 16.54 | | | |
| OIL: | % | 2.02 | | | |
| DENSITY: | lb/cft | 43.70 | | | |
| **3RD UNDERS TO ENDOSPERM STREAM** | | | | | |

| MATERIAL OUT | % |
|---|---|
| SOLIDS | 5.25 |
| OIL | 3.74 |
| MOISTURE | 6.30 |

Fig. 23

SEED PREP AND MILLING RUN 2

ROLLER MILL 3 (5TH OVERS + 8TH OVERS)

| .020 GAP | UNITS | # | lbs OIL | lbs WATER | lbs SOLIDS |
|---|---|---|---|---|---|
| WT IN: | % | 100.00 | 3.99 | 4.45 | 18.20 |
| NET WT | lbs. | 26.64 | | | |

SCREENER 4 (10 MESH)

| > #8 MESH | UNITS | # | lbs OIL | lbs WATER | lbs SOLIDS |
|---|---|---|---|---|---|
| WT IN: | % | 71.13 | 2.84 | 3.17 | 12.94 |
| NET WT | lbs. | 18.95 | | | |
| MOISTURE: | % | 16.71 | | | |
| OIL: | % | 14.98 | 17.99% | DB | |
| DENSITY: | lb/cft | 25.75 | | | |
| **6TH OVERS TO GERM STREAM** | | | | | |

| <8 MESH | UNITS | # | lbs OIL | lbs WATER | lbs SOLIDS |
|---|---|---|---|---|---|
| WT IN: | % | 28.59 | 0.15 | 1.26 | 6.20 |
| NET WT | lbs. | 7.62 | | | |
| MOISTURE: | % | 16.54 | | | |
| OIL: | % | 2.02 | | | |
| DENSITY: | lb/cft | 43.70 | | | |
| **4TH UNDERS TO ENDOSPERM STREAM** | | | | | |

Fig. 24

SEED PREP AND MILLING RUN 2

SIDE B

1ST MIDS FROM SCREENER 1

| <6>8 MESH | UNITS | # | lbs OIL | lbs WATER | lbs SOLIDS |
|---|---|---|---|---|---|
| WT IN: | % | 16.85 | 0.90 | 5.55 | 28.25 |
| NET WT | lbs. | 34.71 | | | |
| MOISTURE: | % | 16.00 | | | |
| OIL: | % | 2.60 | | | |
| DENSITY: | lb/cft | 36.24 | | | |

ASPIRATOR 3

| <6>8 MESH | UNITS | # | lbs OIL | lbs WATER | lbs SOLIDS |
|---|---|---|---|---|---|
| WT IN: | % | 100.00 | 2.47 | 15.50 | 70.01 |
| NET WT | lbs. | 34.71 | | | |
| ASP #3 OVERS | UNITS | # | lbs OIL | lbs WATER | lbs SOLIDS |
| WT IN: | % | 91.00 | 2.28 | 4.67 | 24.64 |
| NET WT | lbs. | 31.59 | | | |
| MOISTURE: | % | 14.78 | | | |
| OIL: | % | 7.22 | | | |
| DENSITY: | lb/cft | 42.61 | | | |
| **7TH OVERS TO SIDE B ROLLER MILL 4** | | | | | |

| ASP #3 UNDERS | UNITS | # | lbs OIL | lbs WATER | lbs SOLIDS |
|---|---|---|---|---|---|
| WT IN: | % | 9.00 | 0.06 | 0.53 | 2.53 |
| NET WT | lbs. | 3.12 | | | |
| MOISTURE: | % | 16.97 | | | |
| OIL: | % | 2.08 | | | |
| DENSITY: | lb/cft | 11.73 | | | |
| **3RD BRAN UNDERS TO BRAN STREAM SCREENER 7** | | | | | |

| MATERIAL OUT | % |
|---|---|
| SOLIDS | 1.52 |
| OIL | 1.12 |
| MOISTURE | 1.89 |

Fig. 25

SEED PREP AND MILLING RUN 2

ROLLER MILL 4 (2ND MIDS + 7TH OVERS)

| .040 GAP | UNITS | # | lbs OIL | lbs WATER | lbs SOLIDS |
|---|---|---|---|---|---|
| WT IN: | % | | 2.56 | 7.26 | 37.52 |
| NET WT | lbs. | 47.34 | | | |

SCREENER 5 (6 AND 8 MESH)

| > #6 MESH | UNITS | # | lbs OIL | lbs WATER | lbs SOLIDS |
|---|---|---|---|---|---|
| WT IN: | % | 7.12 | 0.27 | 0.55 | 2.55 |
| NET WT | lbs. | 3.37 | | | |
| MOISTURE: | % | 16.43 | | | |
| OIL: | % | 7.90 | | | |
| DENSITY: | lb/cft | 30.72 | | | |
| **8TH OVER TO SIDE A ROLLER MILL 3** | | | | | |

| <6>8 MESH | UNITS | # | lbs OIL | lbs WATER | lbs SOLIDS |
|---|---|---|---|---|---|
| WT IN: | % | 54.40 | 0.59 | 4.28 | 20.88 |
| NET WT | lbs. | 25.75 | | | |
| MOISTURE: | % | 16.61 | | | |
| OIL: | % | 2.29 | | | |
| DENSITY: | lb/cft | 40.78 | | | |
| **4TH MIDS TO SIDE B ROLLER MILL 5** | | | | | |

| <8 MESH | UNITS | # | lbs OIL | lbs WATER | lbs SOLIDS |
|---|---|---|---|---|---|
| WT IN: | % | 38.48 | 0.01 | 3.04 | 15.16 |
| NET WT | lbs. | 18.22 | | | |
| MOISTURE: | % | 16.69 | | | |
| OIL: | % | 0.06 | | | |
| DENSITY: | lb/cft | 44.59 | | | |
| **5TH UNDERS TO ENDOSPERM STREAM** | | | | | |

| MATERIAL OUT | % |
|---|---|
| SOLIDS | 9.13 |
| OIL | 0.19 |
| MOISTURE | 10.81 |

Fig. 26

SEED PREP AND MILLING RUN 2

ROLLER MILL 5 (3RD MIDS + 4TH MIDS)

| .010 GAP | UNITS | # | lbs OIL | lbs WATER | lbs SOLIDS |
|---|---|---|---|---|---|
| WT IN: | % | 100.00 | 0.25 | 3.81 | 21.69 |
| NET WT | lbs. | 25.75 | | | |
| MOISTURE: | % | 14.78 | | | |
| OIL: | % | 0.99 | | | |
| DENSITY: | lb/cft | 0.00 | | | |

| MATERIAL OUT | % |
|---|---|
| SOLIDS | 13.06 |
| OIL | 4.41 |
| MOISTURE | 13.54 |

SCREENER 6 (STREAM FROM ROLLER MILLS)

| > #8 MESH | UNITS | # | lbs OIL | lbs WATER | lbs SOLIDS |
|---|---|---|---|---|---|
| WT IN: | % | 40.62 | 0.46 | 1.70 | 8.30 |
| NET WT | lbs. | 10.46 | | | |
| MOISTURE: | % | 16.28 | | | |
| OIL: | % | 4.37 | | | |
| DENSITY: | lb/cft | 30.72 | | | |
| **9TH OVERS TO GERM STREAM** | | | | | |

| <8 MESH | UNITS | # | lbs OIL | lbs WATER | lbs SOLIDS |
|---|---|---|---|---|---|
| WT IN: | % | 59.38 | 0.18 | 2.48 | 12.63 |
| NET WT | lbs. | 15.29 | | | |
| MOISTURE: | % | 16.25 | | | |
| OIL: | % | 1.16 | | | |
| DENSITY: | lb/cft | 44.59 | | | |
| **6TH UNDERS TO ENDOSPERM STREAM** | | | | | |

| MATERIAL OUT | % |
|---|---|
| SOLIDS | 7.60 |
| OIL | 3.07 |
| MOISTURE | 8.84 |

Fig. 27

SEED PREP AND MILLING RUN 2

BRAN ENRICHED STREAM
(1ST, 2ND AND 3RD BRAN UNDERS)

| NET IN | lbs OIL | lbs WATER | lbs SOLIDS |
|---|---|---|---|
| 11.94 | 0.19 | 1.85 | 9.90 |

SCREENER 7 (6 AND 8 MESH)

| > #6 MESH | UNITS | # | lbs OIL | lbs WATER | lbs SOLIDS |
|---|---|---|---|---|---|
| WT IN: | % | 75.00 | 0.13 | 1.47 | 7.35 |
| NET WT | lbs. | 8.96 | | | |
| MOISTURE: | % | 16.43 | | | |
| OIL: | % | 1.50 | | | |
| DENSITY: | lb/cft | 30.72 | | | |
| **10TH OVERS TO BRAN AND TIP CAP STREAM** | | | | | |

| <8 MESH | UNITS | # | lbs OIL | lbs WATER | lbs SOLIDS |
|---|---|---|---|---|---|
| WT IN: | % | 25.00 | 0.00 | 0.50 | 2.49 |
| NET WT | lbs. | 2.99 | | | |
| MOISTURE: | % | 16.69 | | | |
| OIL: | % | 0.06 | | | |
| DENSITY: | lb/cft | 44.59 | | | |
| **7TH UNDERS TO ENDOSPERM STREAM** | | | | | |

Fig. 28

SEED PREP AND MILLING RUN 2

FINAL GERM STREAM

| | UNITS | # | lbs OIL | lbs WATER | lbs SOLIDS |
|---|---|---|---|---|---|
| WT IN: | % | 100.00 | 3.30 | 4.87 | 21.24 |
| NET WT | lbs. | 29.41 | | | |
| MOISTURE: | % | 16.56 | | | |
| OIL: | % | 11.21 | 15.5% | DW | |
| DENSITY: | lb/cft | 30.72 | | | |

| MATERIAL OUT | % |
|---|---|
| SOLIDS | 12.79 |
| OIL | 57.01 |
| MOISTURE | 17.31 |

FINAL BRAN AND TIP CAP STREAM

| | UNITS | # | lbs OIL | lbs WATER | lbs SOLIDS |
|---|---|---|---|---|---|
| WT IN: | % | 100.00 | 0.13 | 1.47 | 7.35 |
| NET WT | lbs. | 8.96 | | | |
| MOISTURE: | % | 16.43 | | | |
| OIL: | % | 1.50 | 1.8% | DW | |
| DENSITY: | lb/cft | 30.72 | | | |

| MATERIAL OUT | % |
|---|---|
| SOLIDS | 4.43 |
| OIL | 2.32 |
| MOISTURE | 5.23 |

FINAL ENDOSPERM STREAM

| | UNITS | # | lbs OIL | lbs WATER | lbs SOLIDS |
|---|---|---|---|---|---|
| WT IN: | % | 100.00 | 1.65 | 26.69 | 135.85 |
| NET WT | lbs. | 164.19 | | | |
| MOISTURE: | % | 16.25 | | | |
| OIL: | % | 1.00 | 1.2% | DW | |
| DENSITY: | lb/cft | 30.72 | | | |

| MATERIAL OUT | % |
|---|---|
| SOLIDS | 81.79 |
| OIL | 28.52 |
| MOISTURE | 94.90 |

DRY MILLING CORN FRACTIONATION PROCESS

RELATED APPLICATION

This application claims priority to U.S. Provisional Application No. 61/089,215, entitled "Dry Milling Corn Fractionation Process," filed Aug. 15, 2008, which is incorporated herein by reference.

FIELD OF THE INVENTION

The invention relates to milling of whole corn kernels; and more specifically to dry milling processes for fractionation of corn or other grain.

BACKGROUND OF THE INVENTION

The basic components of corn kernels are bran and tip cap ("fiber"), endosperm ("starch") and the germ ("lipid"). The tip cap is the outer shell and coating of the germ. The bran is the fibrous membrane that holds the endosperm together. The endosperm is composed of starch bodies that forms the major portion of the kernel. The germ contains the majority of the lipids within the kernel. Corn comes in a number of varieties each defined by its typical or average composition of endosperm, germ, tip cap and bran fractions. One widely used variety is #2 corn having a representative kernel composition as presented in the following table:

| | % of Kernel | % Lipid Content |
|---|---|---|
| Whole Kernel | 100% | 2.6% typical (Higher in some) |
| Endosperm | 81% | <2% |
| Germ | 12% | ~82% |
| Tip Cap | 1% | <1% |
| Bran | 6% | <2% |

Currently, there are many methods to mill or fractionate whole kernel corn and separate these components out into three distinct process streams, a germ steam, an endosperm stream and a bran/tip cap stream.

By fractionating the kernel into these fractions or stream fractions, each of the fractions can be processed more easily and with better yields. The separate streams can be used as a feed stock for various processes and products. For example, the bran stream can be burned as fuel or further extracted to yield pharmaceuticals and/or nutriceuticals. The endosperm stream with its high starch content can be processed into many things, e.g., ethanol and sugar being only two. The germ stream is mainly further processed for its lipid content.

The various methods of fractionation known to those skilled in the art can generally be divided into two primary processing categories, dry milling and wet milling. Wet milling is generally regarded as a very effective technique for producing distinct process streams of relatively high purity. This effectiveness is evident in the fact that the starch, the lipid, and fiber content in each of these streams are very concentrated within its relative stream. While wet milling typically will yield higher purity fractionate streams compared to dry milling, it also is comparatively more expensive than dry milling. Thus, most operations using wet milling are doing so because they need or require these distinct streams as pure as possible. Wet milling could be considered to be or referred to as a "chemical" process.

Dry milling on the other hand is less expensive but does not result in the same degree of separation into distinct process streams; and therefore does not provide the purity required for some operations. A consequence can be the loss or waste of portions of the fractionate, e.g., more germ in the bran fraction represents a potential loss of lipid values. Dry milling typically could be considered a "physical" process.

It would be desirable to provide a dry milling process for corn kernel fractionation that provides improved purity of process streams, and even more desirable to provide a dry milling process that can provide purity levels approaching those achievable with wet milling. Further it is desirable to provide a fractionation process that can yield mixed processed stream of desired composition or degree of mixing for select operations.

SUMMARY OF THE INVENTION

The present invention relates to dry milling fractionation processing of corn. In a method for fractionating corn according to an embodiment of the present invention a feed stream of corn kernel is supplied to an impact mill. The feed stream is processed through the impact mill to form a fractionated kernel stream. The fractionated kernel stream is separated in a first screener to provide three process streams, a first endosperm unders stream, a first mids stream and a first overs stream. The first overs stream is processed through a first aspirator to provide two process streams, a first bran-rich unders stream, and a second overs stream. The second overs stream is serially processed through a first roller mill and a second screener to provide three process streams, a second endosperm unders stream, a second mids stream and an thirds overs stream. The third overs stream is processed through a second aspirator to provide two process streams, an second bran-rich unders stream, and a fourth overs stream. The fourth overs stream is serially processed through a second roller mill and a third screener to provide three process streams, a third endosperm unders stream, a third mids stream and a fifth overs stream. The fifth overs stream is processed, alone or in combination with an additional overs stream through a third roller mill and a fourth screener (or at least one additional roller mill and screener set) to provide two process streams, a fourth endosperm unders stream, and a sixth overs stream.

In another embodiment, the method may include the foregoing and additional steps as follows. The first mids stream is processed through a third aspirator to provide a third bran-rich unders stream and a seventh overs stream. The seventh overs stream is serially processed, alone or in combination with the second mids stream, through a fourth roller mill and a fifth screener to provide three process streams, including a fifth endosperm unders stream, a fourth mids stream and an eighth overs stream. The fourth mids stream is serially processed, alone or in combination with the third mids stream, through a fifth roller mill and a sixth screener to provide a sixth endosperm unders stream and a ninth overs stream.

In yet another embodiment of a method according to the invention, the method may include the some or all of the process steps some above described embodiments and father include the processing of the first, second and third bran-rich unders streams, separately or in any combination thereof, through a seventh screener to provide a seventh endosperm unders stream and a bran fraction overs stream (or a fiber stream).

In a further embodiment, the method may include the some or all of the process steps some above described embodiment and further include one or more of the following: 1) combining the sixth and ninth overs streams (or the first and second germ fraction overs stream); 2) combining the first through sixth endosperm unders streams; and 3) combining the first through seventh endosperm unders streams.

In some embodiments, depending upon the moisture content, the corn kernel may be tempered before supplying the kernel to the impact mill to provide a desire moisture content.

In still another embodiment of a method according to the invention a method is provide for fractionating corn kernel into three high purity fraction streams, an endosperm fraction stream, a bran/tip cap stream (or fiber stream) and a germ fraction stream. The method involves providing at least one processing line comprising an impact mill, a plurality of screeners, a plurality of aspirators, and a plurality of roller mills. Further, a feed stream of corn kernel is supplied to an impact mill and the feed stream is processed through the impact mill to form a fractionated kernel stream. The fractionated kernel stream is processed through a first screener to provide a first endosperm fraction unders stream, a first mids stream and a first overs stream. The first overs and first mids streams are respectively processed through first and second aspirators to separate the streams into sub-streams, including first and second overs sub-streams and first and second bran-rich unders sub-streams. The first overs sub-stream (e.g., the 2nd Overs) or sub-streams thereof are processed through at least one aspirator and a plurality of roller mills and a plurality of screeners to provide a first germ fraction stream, a third bran-rich unders sub-stream and a plurality of endosperm fraction streams. The second overs sub-stream (e.g., the $7^{th}$ Overs) or substreams thereof through a plurality of roller mills and a plurality of screeners to provide a plurality of endosperm fraction streams and a second germ fraction stream. A further step may be included involving processing any one of first, second and third bran-rich unders sub-streams or combinations thereof through a screener to form a bran fraction stream (or a fiber stream) and an endosperm fraction stream.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings.

FIG. 4 is a block flow diagram of a milling processing according to an embodiment of the invention.

FIG. 5 is a table of data from a processing run according to an embodiment of a method of the invention.

FIG. 6 is a table of data from a processing run according to an embodiment of a method of the invention.

FIG. 7 is a table of data from a processing run according to an embodiment of a method of the invention.

FIG. 8 is a table of data from a processing run according to an embodiment of a method of the invention.

FIG. 9 is a table of data from a processing run according to an embodiment of a method of the invention.

FIG. 10 is a table of data from a processing run according to an embodiment of a method of the invention.

FIG. 11 is a table of data from a processing run according to an embodiment of a method of the invention.

FIG. 12 is a table of data from a processing run according to an embodiment of a method of the invention.

FIG. 13 is a table of data from a processing run according to an embodiment of a method of the invention.

FIG. 14 is a table of data from a process run according an embodiment of a method according to the invention.

FIG. 15 is a table of data from a processing run according to an embodiment of a method of the invention.

FIG. 16 is a table of data from a processing run according to an embodiment of a method of the invention.

FIG. 17 is a table of data from a processing run according to an embodiment of a method of the invention.

FIG. 18 is a table of data from a processing run according to an embodiment of a method of the invention.

FIG. 19 is a table of data from a processing run according to an embodiment of a method of the invention.

FIG. 20 is a table of data from a processing run according to an embodiment of a method of the invention.

FIG. 21 is a table of data from a processing run according to an embodiment of a method of the invention.

FIG. 22 is a table of data from a processing run according to an embodiment of a method of the invention.

FIG. 23 is a table of data from a processing run according to an embodiment of a method of the invention.

FIG. 24 is a table of data from a processing run according to an embodiment of a method of the invention.

FIG. 25 is a table of data from a processing run according to an embodiment of a method of the invention.

FIG. 26 is a table of data from a processing run according to an embodiment of a method of the invention.

FIG. 27 is a table of data from a processing run according to an embodiment of a method of the invention.

FIG. 28 is a table of data from a processing run according to an embodiment of a method of the invention.

DETAILED DESCRIPTION OF THE PREFERRED EMBODIMENTS

The following detailed description and FIGS. 1-28 are exemplary in nature and are not intended to limit the scope, applicability, or configuration of the invention in any way. Rather, the following description and the figures provide practical illustrations for implementing exemplary embodiments of the present invention.

With reference to FIGS. 1-4, embodiments of the method of the invention are illustrated in block form showing process flows and steps of the fractionation method according to some embodiments of the invention.

In some embodiments of the invention, a system is provided including or comprising one of more tempering bins, one or more impact mills or pin mills, a plurality of screeners equipped with screens, sieves or other suitable separation or screening elements, a plurality of air aspirators also equipped with screening elements, and a plurality of roller mills. The components may be connected via conveyors or conduits that transport corn kernels or fractionate from one component to another to effect the separation and concentration into streams of increasing purity until distinct streams of desired purity are obtained. In some embodiments of a method according to the invention involve repeatably breaking the kernel and/or the fractionate into pieces and serially segregating those pieces by size and/or density.

The number of each type of system components or pieces of equipment utilized in embodiments of methods according to the invention depend upon the scale of the plant and/or the target purity level of the segregated streams or fractions. For an example, if streams of less purity are the desired end product, a very simple cut or separation can be obtained with fewer steps and mechanical operations. However, if streams of greater purity are the desired end product, a more involved and complex cut or separation would be needed. This could be obtained by increasing the number of systems components and the number of separation steps. In other words, the size of the system and of each individual processing line could be increased or additional process lines may be added depending upon the economics. In some embodiments of methods according to the invention, the system can be scaled up to capacities that will provide desired purity levels at lower costs than the multiple additional processing lines that would be required with known and currently available systems and methods known to those skilled in the art.

Figure 1:
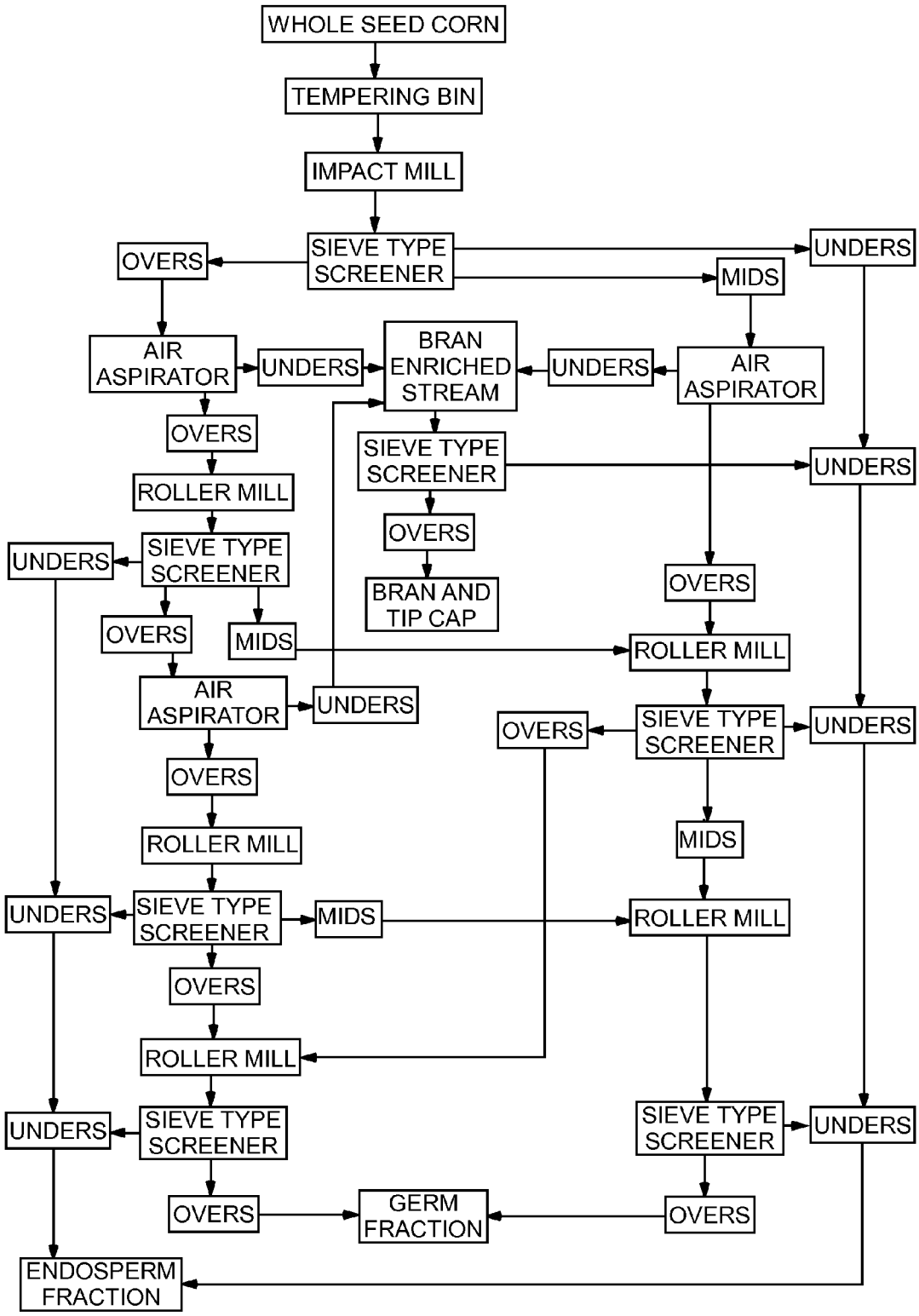
FIG. 1 is a block flow diagram of a milling processing according to an embodiment of the invention.
Figure 2:
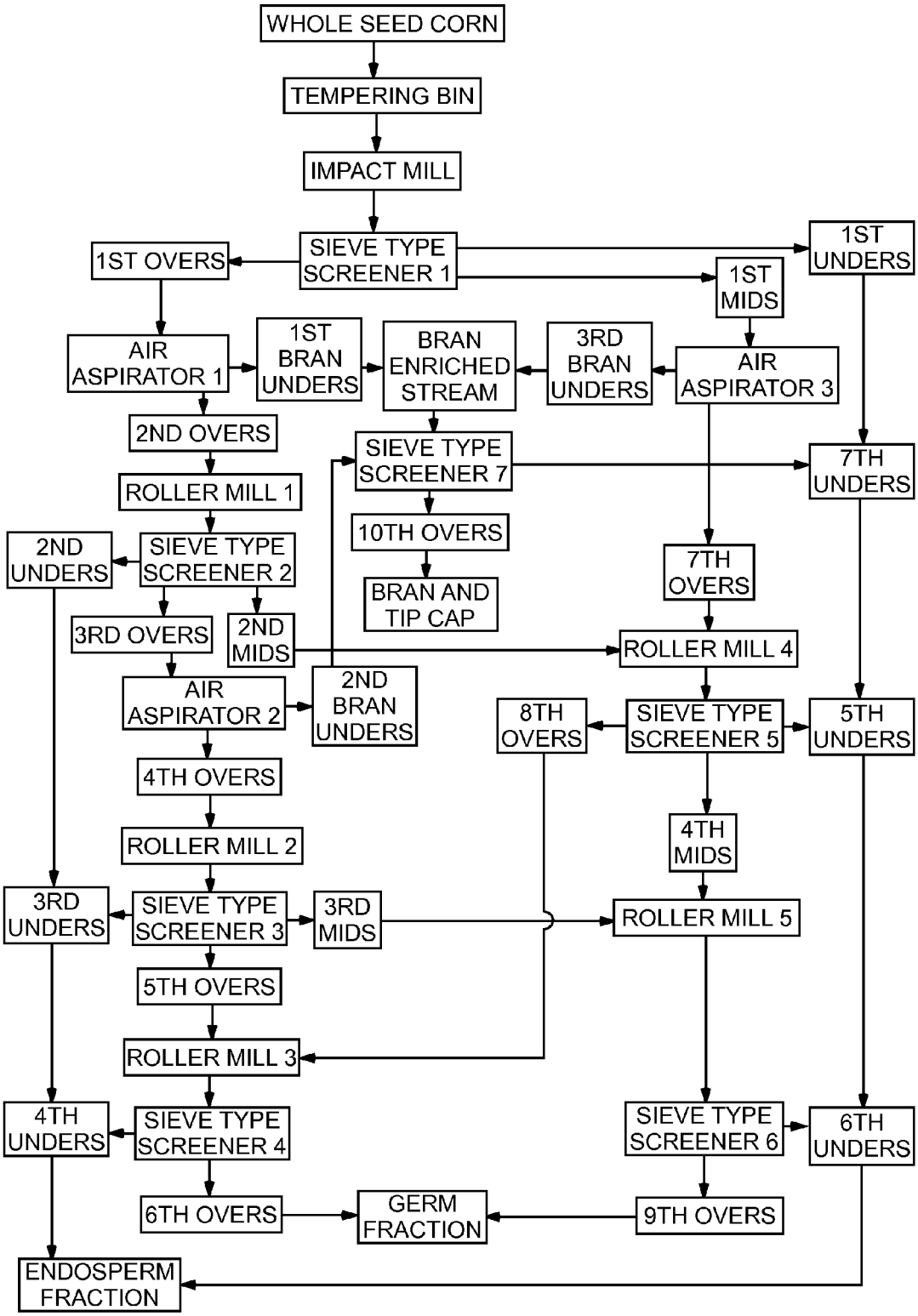
FIG. 2 is a block flow diagram of a milling processing according to an embodiment of the invention.
Figure 3:
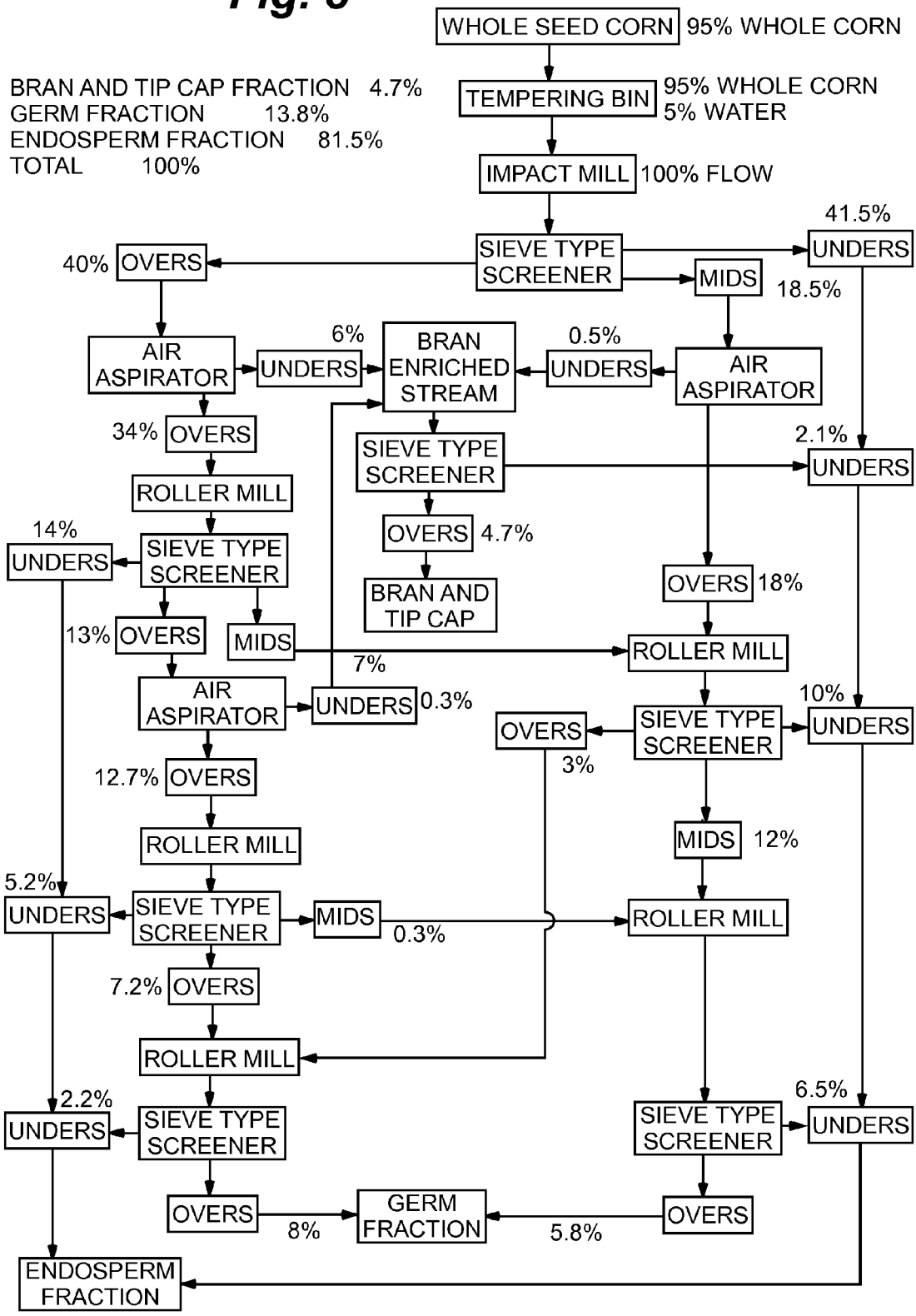
FIG. 3 is a block flow diagram of a milling processing according to an embodiment of the invention.

Methods according to the invention may be understood with reference to the block flow diagrams of FIGS. 1-4. FIG. 1 illustrates the components and streams of an embodiment of a method according to the invention. FIG. 2 illustrates the components and streams of an embodiment of a method according to the invention and additionally individually labels and identifies the components and streams. FIG. 3 also illustrates the components and streams of an embodiment of a method according to the invention and further presents the percent of flow through different components and of individual stream at each cut or separation step. FIG. 4 illustrates the components and streams of an embodiment of a method according to the invention with designation of a portion of the steps being carried out along Side A and a portion of the steps being carried out along a Side B. The references to Side A and Side B are also used in the tables of the process runs presented in the tables of FIGS. 5-28 and are convenient references to aid in following the streams or flows through the steps of an embodiment of a method according to the invention.

With reference to FIGS. 1-4, whole seed or whole kernel corn is subjected to a tempering step utilized to condition the grain for the subsequent grinding or milling operations. The tempering procedure allows the whole kernel grain to absorb moisture and thereby magnifies the different grinding characteristics of the kernel components. Since moisture is absorbed primarily through the tip cap of the germ, the tempering step normally lasts for about one and up to several hours depending upon the end product desired and the age and moisture content of the kernel being processed. Tempering may be carried out in a single step or a plurality of steps (and in a single or plurality of tempering bins) over given time periods using simple water absorption or a combination of water and heat, typically introduced as hot water or steam. Tempering methodologies and conditions known to those skilled in the art may be used to achieve the tempering of the kernels in the embodiments of the method according to the invention.

The tempering step results in the relatively highly absorptive germ and bran becoming tough and pliable as these components take on water. On the other hand, the endosperm, which absorbs moisture much more slowly, will remain relatively unchanged although somewhat less brittle. This procedure also helps to promote parting of the endosperm from the germ and bran components.

Typically, tempering is carried out in a tempering bin at a temperature and for a time sufficient to raise the moisture content to the desired level. In some embodiments of the invention, the kernel coming out of tempering may have a moisture content range or level of about 10% to about 25%, preferably of about 14% to about 22%, and more preferably of about 16% to about 20%. For a first processing run (Milling Run 1, FIGS. 5-16) according to an embodiment of the method of the invention, the moisture content coming out of the tempering step was 19.61%; and for a second processing run (Milling Run 2, FIG. 17-28) according to an embodiment of the method of the invention, the moisture content coming out of the tempering step was 16.35%.

According to other embodiments of a method according to the invention, a tempering step is optional; however, in such embodiments, the method may have reduced efficiency at moisture content levels outside of these ranges. Any conventional tempering bin of the type known to those skilled in the art may be used. A tempering bin is a closed container in which kernels are exposed to moisture in order to absorb moisture over time. Moisture may be introduced in the form of ambient moisture or steam or water. The bin may additionally be heated. Tempering may also be accomplished by immersing kernels in water for a period of time, spraying kernels as they are conveyed from silo or other storage to a holding bin and allowing absorption prior to being conveyed to a degerminator.

Tempering is conventionally carried out for periods of several hours for example 3-6 hours for some processes. In some embodiments of the method of the invention, the tempering step may similarly be carried out over conventional periods of several hours. In some other embodiments, the tempering step is carried out over a period of less than 3 hours hour. And in yet some other embodiments, the tempering step is carried out for a period of about 10 minutes up to an hour. Thus, tempering may be carried out over a period of 10 minutes up to 6 hours. Based upon the moisture content of the kernels when received or prior to introduction to the impact mill and depending upon the tempering technique used, those skilled in the art will be able to determine the tempering time needed to reach the desired moisture content.

After tempering, the tempered kernels are conveyed for degermination. Various mill designs exist to carry out a step of degermination, e.g., attrition mills, impact mills and roller mills. For example, the Ocrim degerminator uses a spinning rotor having combination blades to operate against a horizontal, perforated cylinder that only allows partial kernels to pass. The rotor and breaker bars are set to break the corn against a spiral rotor bar and a cutting bar. Another known degerminator is the Beall degerminator. In the Beall degerminator, grinding occurs through an abrasive action of kernel against kernel, and kernel against a nested conical surface and screen. Impact-type degerminators are also used. An example is the Entoleter degerminator which includes a vertical drive shaft that operates a rotor. Kernels are fed downwardly towards the rotor where they are forced outwardly by centrifugal motion to impact a liner surface. Another example is the Sturtevant Simpactor degerminator.

Impact degermination is typically used for milling where finished products having high fat content is acceptable, such as table meal; and where fine granulation and/or intermixing of the kernel fractions is desired. However, the separation of the germ that has been achieved with impact milling has been poor due to breaking of the germ, fine granulation and intermixing of the fractions before separation. This makes it more difficult to separate the fractionate into process streams of desirably high purity or of desired composition.

Applicants have found that with use of impact milling, specifically a pin mill, they can achieve good initial separation of the germ, bran and endosperm without undesirable breakage of the germ. A non-limiting example of a commercially available pin mill that can be used in methods according to the invention is the Sturtevant Simpactor® mill which is a centrifugal, pin-type impact mill that reduces low- to medium-density materials to uniform fine particle sizes of 50-200 mesh.

From the impact (pin) mill, the impacted kernel is fed to a sieve type screener, Screener 1, where the separation step begins and the fractionated kernel is separated into or diverted by particle size into three process streams, the endosperm (unders) stream, the mids stream, and the overs stream. With reference to FIG. 2, these three stream are identified as $1^{st}$ Overs, $1^{st}$ Mids, and $1^{st}$ Unders and the streams at the various steps along the way are similarly named for both of the milling runs.

As the milling process proceeds, the composition of the streams will change in part due to screen sizes and roller mill spacing, and negative air (air flow through aspirator), and pin mill speed. By adjusting one or more or combination of these parameters, the composition of the process stream can be tailored to provide process streams of intermediate or final composition according to the intended use, intermediate or final, of the process stream.

Processing through a screener can provide different process streams depending upon how many screens are provided. For example, a screener equipped with a single screen will separate the fractionate into two process streams, an overs and an unders. A screener equipped with two screens one of larger mesh than the other, will separate the fractionate into three streams, an overs, a mids and an unders. With addition of a third screen, the fractionate can be separated into an overs, a plurality of mids (or first mids and second mids streams) and an unders. It will be understood by those skilled in the art that further separation of the mids stream can be obtained, as necessary, by the equipping screeners with additional screens of increasing mesh size or number.

With reference to FIGS. 1-4, there is illustrated in the flow diagram an embodiment of the method according to the invention, where Screener 1, 2, 3, 5 are equipped with 2 screens and separate the feed stream entering the screener into 3 streams, overs, mids and unders. Screeners 4, 6 and 7 are each equipped with a single screen and the output is an overs stream and an unders stream. As previously mentioned, corn kernel is generally composed of an endosperm or starch fraction, a germ fraction and a bran/tip cap fraction. As the process of the invention is carried out the relative composition of the streams vary as effective separation will result in isolation or concentration of endosperm in unders streams from Screeners 1, 2, 3, 4, 6, and 7.

Separation is also carried out in aspirators producing two streams, an overs and an unders. Here separation is not determined by screen number or mesh size, rather, separation is achieved as a result of a combination of factors, weight of fractionate particles, gas flow rate through the aspirator, and gravity amongst others. The heavier particles fall to the bottom of the aspirator as overs ($2^{nd}$Overs, $4^{th}$ Overs and $7^{th}$ Overs in FIG. 2); and the lighter fraction ($1^{st}$ Bran Unders, $2^{nd}$ Brand Unders and $3^{rd}$ Bran Unders in FIG. 2) is carried up with the gas or air flowing in the counter-flow separation device.

Bran is interspersed throughout and bound to the endosperm. After initial impact milling, further fractionation to physically break the bran from the endosperm is achieved with the roller mills and further separation of the fractions is achieved with the screeners and the aspirators.

After initial impact milling and separation through Screener 1, the overs stream ($1^{st}$ Overs) is composed of a mixture of particles too large to pass through the first screen and will include endosperm, bran/tip cap and germ fractions. The unders stream ($1^{st}$ Unders) is composed primarily of endosperm that has passed through both screens. The mids stream ($1^{st}$ Mids) will contain some of each fraction having particle sizes small enough to pass through the first screen but too large to pass through the second or last screen.

Referring to the flow diagrams, the endosperm or unders stream is composed primarily of endosperm. The mids stream is a mixed fraction stream composed of a endosperm, bran/tip cap and germ fractions. The overs stream is composed of primarily of germ but additionally includes some bran/tip cap and endosperm fractions as part of large sized particles. Examples of commercially available sieve type screeners include but are not limited to Sweco Screener, by Rotex Screener, made by Rotex. Screeners can be purchased with one or more screens or a full set of screens having for a variety of mesh sizes.

Referring back to FIGS. 1-4, the separation continues from Screener 1 with the overs stream ($1^{st}$ Overs) and mids stream ($1^{st}$ Mids) being diverted or conveyed to their respective air aspirators, Aspirator 1 and Aspirator 3. Within these aspirators the lighter fraction, which includes high composition of bran/tip cap fraction and some endosperm, is concentrated to form a bran enriched unders stream, referred to Bran Unders. Aspirators suitable for use in methods according to some embodiments of the invention include but are not limited to the Crown Cascade aspirator available from the Crown Iron Works Company. In the aspirator, the material in the stream free falls through a series of impact rollers, further breaking bonds between particles composed of two or more fractions. The heavier fraction (is discharged from the bottom of the aspirator. The lighter fraction is lifted by counter-current air flow to the top of the aspirator and subjected to final rectification where entrained heavier fractions are removed and allowed to fall toward the bottom of the aspirator.

The heavier fraction or overs stream ($1^{st}$ Overs) from Screener 1 is directed to Aspirator 1 and the unders stream ($1^{st}$ Bran Unders) is routed therefrom for processing through Screener 7 as part of the bran enriched stream mentioned above. The overs stream ($1^{st}$ Overs) continues on from Aspirator 1 to be processed through a roller mill, Roller Mill 1, and then routed through Screener 2. From Screener 2, this process stream is divided into a post-Screener 2 unders stream ($2^{nd}$ Unders) that is composed primarily of endosperm fraction and is routed for further processing or handling possibly with other endosperm rich streams, a post-Screener 2 mids stream ($2^{nd}$ Mids) that is routed for further processing, and a post-Screener 2 overs stream (3r Overs). The mids stream from Screener 2 ($2^{nd}$ Mids) is conveyed for further processing through Roller Mill 4 and may be processed separately or as a combined stream with post Aspirator 3 overs stream ($7^{th}$ Overs).

Roller mills used in embodiments of the method of the invention may include but are not limited to corrugated or smooth rollers, rubber rollers or rollers covered with rubber. Additionally, it should be understood that rollers may be provided as one or more roller stacks, so single stack, double stack, triple stack, etc. may be used as needed to providing additional milling of the fractionate or process streams.

Returning to FIG. 2, Post Screener 2 overs stream (3rd Overs) is then processed in Aspirator 2. The post Aspirator 2 overs stream ($4^{th}$ Overs) is processed through Roller Mill 2 and then through Screener 3 to provide post Screener 3 overs ($5^{th}$ Overs), mids ($3^{rd}$ Mids) and unders ($3^{rd}$ Unders) streams. As necessary to achieve the desired level of purity the post Screener 3 overs stream may be serially or repeatedly roller milled, screened, and segregated until desired germ content is met in the overs stream and the resulting unders stream is diverted to be collected with other unders stream from other screeners. As illustrated in the flow diagram, post Screener 3 overs stream ($5^{th}$ Overs) is processed through Roller Mill 3, either separately or in combination with post Screener 5 overs stream ($8^{th}$ Overs). From Roller Mill 3, the overs stream is processed through Screener 4 with an endosperm rich under stream ($4^{th}$ Unders) being directed for processing, handling and/or combination with other endosperm rich unders streams. If the post Screener 4 overs stream is sufficiently germ rich, this over stream ($6^{th}$ Overs) may be directed for additional handling or combined with other germ rich over streams. If the post Screen 4 overs stream does not have the desired level of purity, the stream may, as mentioned, be routed through addition roller mills and screeners as necessary or up to the point of diminishing returns or when the fractions are so clean no further separation is merited.

The under stream ($2^{nd}$ Bran Unders) from Aspirator 2 is conveyed for processing as a bran enriched stream and may be processed through Screener 7 separately or joined with the under streams from Aspirator 1 and Aspirator 3 (respectively, $1^{st}$ Bran Unders and $3^{rd}$ Bran Unders) as a combined bran enriched stream and processed through Screener 7. The resulting post Screener 7 overs stream ($10^{th}$ Overs) may then be collected as a bran/tip cap fraction of desired purity level. The resulting post Screener 7 unders stream ($7^{th}$ Unders) is diverted for further processing or handling alone or in combination with other endosperm rich under streams.

As previously mentioned, the post Screener 2 mids ($2^{nd}$ Mids) and the post Aspirator 3 overs ($7^{th}$ Overs) are processed through Roller Mill 4 and routed through Screener 5 to be separated into an endosperm rich unders stream, a mids stream, and an overs stream. The resulting post Screener 5 overs stream ($8^{th}$ Overs) is routed for separate or joint processing with post Screener 3 overs stream ($5^{th}$ Overs) through Roller Mill 3 with further processing following Roller Mill 3 proceeding as previously described. Post Screener 5 unders stream ($5^{th}$ Unders) is also diverted for further processing or handling alone or in combination with other endosperm rich under streams.

The post Screener 5 mids stream ($4^{th}$ Mids) may be separately processed or combined with the post Screener 3 mids stream ($3^{rd}$ Mids) and processed through Roller Mill 5 and then through Screener 6 to provide an unders stream ($6^{th}$ Unders) and a germ rich overs stream ($9^{th}$ Overs) that may be combined with the germ rich overs stream from Screener 4 ($6^{th}$ Overs) and from any additional screeners that follow Screener 4 as necessary. As previously mentioned regarding the overs from Screener 4 ($6^{th}$ Overs), the $9^{th}$ Overs may also, as necessary, be repeatedly roller milled, screened, and segregated until desired germ content is met and the germ rich overs stream may be collected along with other germ rich streams. The resulting under streams from subsequent screenings are routed to join the other under streams in a endosperm fraction of desired purity.

The separation with respect to the primary three fractions is illustrated in FIG. 4 with a legend identifying a Side A and a Side B of the process steps and components in the flow diagram. The Side A and Side B designations will aid in following the flows with respect to the data presented in the tables for Milling Run 1 and Mill Run 2 of FIGS. 5-16 and FIGS. 17-28 respectively.

The effective separation and segregation of fractionate and process streams of desired composition or purity is demonstrated by the data for Milling Run 1 and Milling Run 2.

Referring to FIGS. 5-16, data from Milling Run 1 is presented based upon a sample process milling run utilizing flow of 450 lbs of kernel, having a moisture content of about 14.32% before tempering and a moisture content of 19.61%, and a total weight of about 473.81 lbs after tempering and before introduction to the Impact Mill and then Screener 1. With reference to FIGS. 17-28, data for Milling Run 2 is presented based upon a sample process run utilizing a flow of 200 lbs of kernel, having a moisture content of about 14.06% before tempering and a moisture content of 16.35% and total weight of about 206 lbs after tempering and before introduction to Screener 1.

With reference to FIGS. 5-28 and depending upon the stage in the process, composition of the streams entering and exiting as under, mids or overs is provided at each cut or separation or processing step through screeners and aspirators. Also provided for purposes of illustration are the mesh sizes of the screens in screeners and gap spacing of the rollers. Impact mill speeds can range between 200 to 3000 rpm. Depending upon the type of roller, roller speed ranges can vary. For example for some rollers, the speed can range from 900 to 1500 rpm. Gas flow rates for aspirators can range between about 1 to about 5 $ft^3$/min. As previously, mentioned these and other parameters may be varied or adjusted depending upon the type of corn and composition of the kernel and/or the desired fractional composition of the end product or process stream and such variations and adjustments are contemplated and within the scope of the invention.

One skilled in the art will readily understand that such adjustments may be needed due to variations in such things as germ size between corn varieties for example or desired throughput or processing speed. Further, while the end product is typical a germ-rich stream, an endosperm-rich stream or a bran-rich stream, the method of the invention may be utilized to provide mids streams of desired or specified composition depending up the needs of the end-product uses as a feedstock for another process or product.

In FIG. 3, the percent of flow of the streams in Milling Run 1 is provided at each cut, i.e., as the stream comes out of screeners and aspirators, as a percent of the initial flow through the impact mill which is indicated as 100 percent.

From the data presented for Milling Runs 1, certain observations can be made. For this process run, the resulting bran/tip cap stream of the process tends to be low in remaining flour and residual oil. The endosperm stream tends to be low in residual lipid as well. The germ stream has an elevated level of oil content similar to the current levels found in current dry processed corn germ. With respect to Milling Run 2, residuals have been concentrated to as high as 26% on a dry weight bases. Ranges of 9 to 28% residual oil can be expected by using an embodiment of a method according the present invention.

The flow diagrams presented in FIGS. 1-4 constitute a single process line coming off of the impact mill. The volume that can be processed through a single line depends upon the degerminator capacity; however, a process line can typically handle up to a calculated limit of about 24% of between 360-500 tons/day of kernel. Actual capacity may be less or more than 24%. Regardless, if a facility is seeking to increase its overall processing capacity, one or more additional lines may be added as necessary to handle the desired volume While a preferred embodiment of the present invention has been described, it should be understood that various changes, adaptations and modifications may be made therein without departing from the spirit of the invention and the scope of the appended claims.

What is claimed:

1. A method for fractionating corn kernel comprising:

supplying a feed stream of corn kernel to an impact mill;

processing the feed stream through the impact mill to form a fractionated kernel stream;

separating the fractionated kernel stream in a first screener to provide three process streams, a first endosperm unders stream, a first mids stream and a first overs stream;

processing the first overs stream through a first aspirator to provide two process streams, a first bran-rich unders stream, and a second overs stream;

serially processing the second overs stream through a first roller mill and a second screener to provide three process streams, a second endosperm unders stream, a second mids stream and an thirds overs stream;

processing the third overs stream through a second aspirator to provide two process streams, an second bran-rich unders stream, and a fourth overs stream;

serially processing the fourth overs stream through a second roller mill and a third screener to provide three process streams, a third endosperm unders stream, a third mids stream and a fifth overs stream; and serially processing the fifth overs stream, alone or in combination with an additional overs stream through a third roller mill and a fourth screener to provide two process streams, a fourth endosperm unders stream, and a sixth overs stream.

2. The method of claim 1, further comprising the steps of:

processing the first mids stream through a third aspirator to provide a third bran-rich unders stream and a seventh overs stream;

serially processing the seventh overs stream, alone or in combination with the second mids stream, through a fourth roller mill and a fifth screener to provide three process streams, including a fifth endosperm unders stream, a fourth mids stream and an eighth overs stream; and serially processing the fourth mids stream, alone or in combination with the third mids stream, through a fifth roller mill and a sixth screener to provide a sixth endosperm unders stream and a ninth overs stream or a second germ fraction overs stream.

3. The method of claim 2 further comprising the steps of:

processing the first, second and third bran-rich unders streams, separately or in any combination thereof, through a seventh screener to provide a seventh endosperm unders stream and a bran fraction overs stream.

4. The method of claim 2, further comprising the step of:

combining the sixth and ninth overs streams.

5. The method of claim 2, further comprising the step of:

combining the first through sixth endosperm unders streams.

6. The method of claim 3, further comprising the step of:

combining the first through seventh endosperm unders streams.

7. The method of any one of claims 1-6, further comprising tempering the corn kernel before supplying the kernel to the impact mill.

8. A method of fractionating corn kernel into three high purity fraction streams, including an endosperm fraction stream, a bran/tip cap stream, and a germ fraction stream, comprising:

providing at least one processing line comprising an impact mill, a plurality of screeners, a plurality of aspirators, and a plurality of roller mills;

supplying a feed stream of corn kernel to an impact mill;

processing the feed stream through the impact mill to form a fractionated kernel stream;

processing the fractionated kernel stream through a first screener to provide a first endosperm fraction unders stream, a first mids stream and a first overs stream;

processing the first overs and first mids streams respectively through first and second aspirators to separate the streams into sub-streams, including first and second overs sub-stream and first and second bran-rich unders sub-streams;

processing the first overs sub-stream or sub-streams thereof through at least one aspirator and a plurality of roller mills and a plurality of screeners to provide a first germ fraction stream, a third bran-rich unders sub-stream and a plurality of endosperm fraction streams; and processing the second overs sub-stream or sub-streams thereof through a plurality of roller mills and a plurality of screeners to provide a plurality of endosperm fraction streams and a second germ fraction stream.

9. The process of claim 8, further comprising the step of:

processing any one of first, second and third bran-rich unders sub-streams or combinations thereof through a screener to form a bran fraction stream and an endosperm fraction stream.

* * * * *